US012416158B2

(12) United States Patent
Sillik et al.

(10) Patent No.: US 12,416,158 B2
(45) Date of Patent: Sep. 16, 2025

(54) SUPPORT STRUCTURES FOR INSULATION AND OTHER MATERIALS

(71) Applicant: SPEED ROD, LLC, Tucson, AZ (US)

(72) Inventors: Francisco Sillik, Tucson, AZ (US); Patrick Wood, Tucson, AZ (US); Christofer Willis, Tucson, AZ (US); Klaus Axen, Tucson, AZ (US)

(73) Assignee: SPEED ROD, LLC, Tucson, AZ (US)

( * ) Notice: Subject to any disclaimer, the term of this patent is extended or adjusted under 35 U.S.C. 154(b) by 0 days.

(21) Appl. No.: 18/357,929

(22) Filed: Jul. 24, 2023

(65) Prior Publication Data

US 2025/0034878 A1 Jan. 30, 2025

(51) Int. Cl.
*E04D 13/16* (2006.01)
*E04B 1/76* (2006.01)

(52) U.S. Cl.
CPC ..... *E04D 13/1625* (2013.01); *E04B 1/7666* (2013.01)

(58) Field of Classification Search
CPC ..... E04D 13/1625; E04B 1/7666
See application file for complete search history.

(56) References Cited

U.S. PATENT DOCUMENTS 3,355,203 A * 11/1967 Stauffer ..... E04B 1/7666 52/712
4,437,282 A * 3/1984 O'Brien ..... E04B 1/7666 248/302
4,715,156 A * 12/1987 Dozzo ..... E04D 13/1625 52/404.3
5,901,518 A * 5/1999 Harkins ..... E04D 13/1625 52/404.3
6,487,825 B1 * 12/2002 Sillik ..... E04B 1/7666 52/406.1
7,530,207 B2 * 5/2009 Morrill ..... E04D 13/1625 52/DIG. 1
8,661,763 B2 * 3/2014 Oberg ..... E04D 13/1625 52/650.1
9,605,426 B2 * 3/2017 Robins ..... E04B 1/7604
10,301,818 B1 * 5/2019 Harkins ..... E04D 13/16
(Continued)

FOREIGN PATENT DOCUMENTS

GB 2456883 A * 8/2009 ..... E04B 1/7666

OTHER PUBLICATIONS

Simpson strong-tie carbon steel wire insulation support, dated by archive.org at Jul. 31, 2021 https://www.strongtie.com/miscellaneousconnectors_woodconnectors/is_support/p/is (Year: 2021).*
(Continued)

*Primary Examiner* — Terrell L McKinnon
*Assistant Examiner* — Ding Y Tan
(74) *Attorney, Agent, or Firm* — Quarles & Brady LLP; Michael J. Curley

(57) ABSTRACT

A holder for supporting a material such as insulation. The holder includes a support member having a first and a second wire element for supporting the material, with each of the first and second wire elements having a first end and a second end adapted to engage two beams. The first and second wire elements also are coupled together by a serpentine section defining a planar holding surface. The second ends include U-shaped clamping members.

11 Claims, 6 Drawing Sheets

(56) References Cited

U.S. PATENT DOCUMENTS

| | | | | |
|---|---|---|---|---|
| 2005/0183368 | A1* | 8/2005 | Morrill | E04D 13/1625 52/506.01 |
| 2007/0062140 | A1* | 3/2007 | Sillik | E04B 1/7654 52/404.1 |
| 2007/0062141 | A1* | 3/2007 | Sillik | E04B 1/7666 52/407.3 |
| 2007/0090267 | A1* | 4/2007 | Sillik | E04D 13/1625 248/510 |
| 2008/0000181 | A1* | 1/2008 | Sillik | E04D 13/1625 248/302 |
| 2008/0120940 | A1* | 5/2008 | Smith | E04B 5/12 52/712 |
| 2012/0151869 | A1* | 6/2012 | Miller | E04B 1/7666 52/655.1 |
| 2016/0130801 | A1* | 5/2016 | Jakobsen | E04D 3/36 52/404.1 |
| 2016/0190781 | A1* | 6/2016 | Hendricks | H02G 1/04 294/132 |
| 2017/0051502 | A1* | 2/2017 | Wolf | E04B 1/7666 |
| 2022/0131349 | A1* | 4/2022 | Harrell | H02G 1/085 |

OTHER PUBLICATIONS

Crain 90520 gopher pole wire installation tool sold on Specialized Products company dated by archive.org at May 13, 2023, https://www.specialized.net/crain-90520-gopher-pole-wire-installation-tool-22.html (Year: 2023).*

Karoka zip ties sold on amazon.com with 50 lb tensile strength dated Dec. 10, 2021 https://www.amazon.com/Tensile-Strength-Resistant-outdoor-Karoka/dp/B09K63DNQ5?th=1 (Year: 2021).*

* cited by examiner

SUPPORT STRUCTURES FOR INSULATION AND OTHER MATERIALS

BACKGROUND OF THE INVENTION

Field of the Invention

The invention relates generally to supporting materials inside of structures and more particularly to support structures or holders that are especially useful to support insulation.

Description of the Related Art

Insulation installed underneath a roof (i.e., on a building ceiling) is typically placed between two ceiling rafters, studs, beams or joists. Wall insulation (or specialized insulation such as sound proofing materials) is often laid between studs from long rolls, long strips, or long flat pieces (i.e., "batts"). In the case where insulation is installed on the ceiling, between ceiling beams, it must be held in place prior to the finished ceiling material (e.g., the drop ceiling frame or drywall) being installed. Without some support, the insulation material will tend to sag or peel itself off the ceiling, making installation difficult.

Conventionally, hangers are used to support insulation between ceiling rafters or studs prior to installation of the finished ceiling. A conventional insulation hanger includes a platform and a spike or tapered prong, which is anchored into the rafters or the studs by hammering. Obviously, it takes a great deal of time to install insulation this way since the number of hangers that must be hammered in each stud is large. In addition, the pointed ends or tapered prongs on the ends of certain types of adjustable hangers are not easily or satisfactorily driven into wooden joists at desired locations or at prescribed spacing due to imperfections in the wooden joists such as knots, holes, cracks and the like. And if the part of the hanger that is driven into the joist becomes dull or breaks off during installation or repeated attempts at installation (or if the joist is metal or another material not suited for attachment by hammering), these types of brackets become essentially useless for the intended purpose. Furthermore, the pointed ends or prongs of some support members occasionally become unseated, thereby allowing the material that is being supported to sag and lose some of its function (e.g., reduction of the R-value of insulation through compaction), or worse, the insulation bat will come loose and will put pressure on ceiling mechanicals such as ducts or pipes, which themselves may become loose or break.

Other conventional insulation hangers are wires attached to pointed fasteners that are driven into the faces of ceiling studs. These are difficult to use as they require two nailing steps for installation, and the resulting wire hanger provides a linear support that allows the insulation roll or batt to flop down over the wire during and after insulation. Flexible wires used in these hangers may also stretch or sag, opening up gaps between the insulation and ceiling.

Other insulation hangers are essentially thin rods with pointed ends, which are wedged between rafters as the insulation is installed. One disadvantage to these supports is that they only apply a line of contact with the insulation, which is free to bend down around the support. Additionally, these linear, rod-like hangers will tend to bend into an arcuate shape upon installation, because they are being held in tension by pressure by the studs at the ends of the device. These devices will then tend to rotate down about an axis created by the points of contact with the studs, such that the apex of the arc is pointed down. This will cause insulation to sag, and will open up air gaps, further degrading the performance of the insulation.

Co-owned U.S. Pat. No. 6,487,825 entitled "Holder for Insulation" represents an improvement over prior art. That patent describes an insulation hanger having two upwardly opening u-shaped members that can engage ceiling rafters in a clamping fashion. The two u-shaped members are connected by two horizontal supporting arms that lay parallel and alongside one another, and are slidingly joined so that, together, they can telescope and increase the distance between the u-shaped members. The supporting arms, together, provide a horizontal line of contact to support insulation. While an improvement, the foregoing insulation hanger still suffers from the drawbacks of the prior art rod system, which is that by providing an essentially linear support, the insulation can deflect down, and may even fall out of the rafter during insulation.

U.S. Pat. No. 4,437,282 discloses an insulation support that is formed of a lattice or ladder like structure that defines a planar insulation support surface. This structure is pushed up between rafters, and is anchored by an interference fit between the lateral extent of the device and the inter-rafter spacing. Anchoring of the support is enhanced by pointed ends of the device that dig into the wooden surface of the rafters. This device is an improvement over prior art insulation support in that it provides a planar support surface for the insulation batt. However, this device is usable only to support insulation within and between rafters. An installation using this device provides no insulation over the bottom surfaces of the rafters, which reduces the overall insulating potential of the insulating ceiling. Additionally, this device is usable only with a fixed inter-rafter spacing, and is not adjustable for varying inter-rafter spacing.

Co-owned U.S. Patent Application Publication No. 2008/0000181 (application Ser. No. 11/853,663) and U.S. Patent Application Publication No. 2007/0062140 (application Ser. No. 11/301,197), both entitled Support Structures for Insulation and Other Materials, represent significant improvements over prior art insulation hangers. Those references are incorporated in their entirety into the instant application for all purposes. U.S. Patent Application Publication No. 2007/0062140, in connection with FIG. 2A, discloses an insulation hanger having two upwardly facing square-U shaped clamps that engage with ceiling rafters and support a horizontal support shelf. The support shelf is defined by a serpentine or accordion-like wire structure having a W shape, that can be expanded by the installer to accommodate varying widths of insulation. While the aforementioned support represents a significant improvement over the prior art, it still suffers certain disadvantages. For example, the support disclosed in Publication No. 2007/0062140's FIG. 2A discloses vertical wire members 46 that are below the outside (lateral) surfaces two adjacent rafters. While this permits the installed installation to fill the entire area between the vertical wire members 46, this design necessarily results in interference with insulation from an adjacent pair of rafters, assuming that the supports are the same width. This requires that an installer cut or trim every other insulation batt to make it thinner than the inter-rafter spacing, which is inconvenient and time consuming. Additionally, this reference does not disclose elongated stud finders on the lateral sides of the u-shaped clamping sections to more effectively locate stud edges before installation.

U.S. Patent Publication No. 2008/0000181, in connection with FIG. 14, describes an improved hanger having an "X"

configuration comprising two linear rods held together by a coupler, which may comprise a spring. The hanger is pushed up between a pair of rafters and the ends of the rods have an interference fit in the inter-rafter space and provide a substantially horizontal support shelf. While this configuration is an improvement, this reference does not disclose that the two rods are held rigidly with respect to one another, both in translation and rotation. Indeed, in at least one embodiment, this reference describes the coupling element as a spring, which may allow the rods to slide past one another and rotate around one another. As a result, an X hanger made in accordance with this disclosure may allow the ends of one of the rods to rotate down with respect to the other, which may allow the insulation to sag from the ceiling.

Thus, it continues to be desirable for there to be a support member that provides a "shelf-like" support area for more stably supporting materials such as insulation, which such a device accommodates complete coverage of the ceiling and is easy to align to the rafters and install.

SUMMARY OF THE INVENTION

The invention relates in general to an article for holding a material in place, such as a wide strip or batt of insulation. The article includes a first and second wire elements having a first end and a second upwardly opening u-shaped openings adapted to engage two substantially parallel beams or rafters. The u-shaped openings may be square u-shaped, and optionally, are arranged to be in the same plane, which is a first plane. The first and second wire elements are coupled together by a serpentine, Z-shaped rod arranged in a second plane that is perpendicular to the first plane. The serpentine rod may be arranged in an accordion fashion such that it may be expanded or compressed to define a substantially planar holding surface of variable width to support insulation.

In one embodiment, the first and second wire elements have vertically extending portions that extend vertically from the planar holding surface defined by the serpentine rod. Preferably, the vertical extent of the vertically extending portions can be varied by the user, who can select a bend point on the device to define the length of the vertically extending portions. Thus, the article can accommodate installation of variable thicknesses of insulation, and may be adjusted to always place the upper surface of the insulation bat in contact with the ceiling.

In one embodiment, the u-shaped openings, and the specifically, the center, vertical axes or centerlines of the u-shaped elements, are centered on the vertically extending portions. The vertically extending portions, in turn, form or define the first and second edges of the holding surface. This causes the edges of the holding surface to extend to the middle of the u-shaped portions, which enables insulation coverage for half the surface area of the downward facing edges of adjacent rafters or beams. This is advantageous because it allows the installation of insulation that covers the entirety of the ceiling surface, including the downward facing surface of the rafters or joists, which is a significant improvement over conventional hangers. Because of this arrangement, each hanger allows insulation to extend to the center of each of the rafters to which the hanger is installed, and full installation coverage of the ceiling is obtained with additional hangers used on sequential pairs of rafters. No interference between adjacent insulation rolls occurs, as in the prior art, and no consequent trimming is required.

In one aspect, the hanger described above is provided in a first or packed configuration, with all elements arranged in a plane, such that multiple hangers can be flat packed for easy shipping.

In one aspect, the U-shaped anchor portions include a horizontal connecting portion, and two vertically extending portions. The first vertically extending portion may include medially extending (i.e., toward the inside of the U, and toward a side surface of a stud) hook that will tend to dig into and catch on the stud when the hanger is subjected to downward force. The second vertically extending portion includes a continuous loop or arcuate shape on its distal end. The length of the second vertically extending portion is greater than the first vertically extending portion such that the loop extends up above the hook. The second vertically extending portion with the closed loop at the distal end serves as an alignment guide, usable to find the edge or corner of a stud and guide the device into alignment with the stud. This allows easy alignment and installation while reducing the risk that the hook snags on a stud. In a preferred arrangement, the stud finder portion (i.e., the second vertically extending portion) is located on the inside sides (i.e., medial sides) of each u-shaped anchoring portion.

In one aspect, the invention includes an installation tool for installing an insulation hanger having a variable height and a holding surface having a user-settable width. The installation tool enables an insulation hanger carrying insulation to be installed from the floor, rather than a ladder, which enhances convenience and reduces risk of fall injury to installation workers.

In another embodiment, the invention is directed to an alternative hanger for securing insulation between a pair of rafters. The alternative hanger comprises two stiff but flexible rods that are joined together halfway along their respective lengths with a coupler. The coupler allows an installer to bend the first and second ends of each rod outwardly from the coupler to produce an X shape. The degree of the bend determines the width of the device, as well as the horizontal extent of the insulation support shelf created by the hanger. The degree of the bend is adjustable. The width of the device is preferably selected by the user to be slightly larger than the inter-rafter spacing of a building on which the user is installing insulation. The user installs the device by pushing it up between the rafters after installation has been placed. The ends of the rods engage interior surfaces of the rafters, and an interference fit between the device and the interior spacing between rafters secures the device and supports the installation. The coupler, preferably, defines two parallel, hollow, cylindrical barrels, each of which is crimped or otherwise secured to each rod received by the coupler. The coupler secures each rod such that each rod is prevented from either rotating or translating with respect to the coupler and with respect to the other rod. In alternative embodiments, the ends of each rod are configured by bending to define a support contact area capable of forming, in combination with the other rods of the device, a surface having a horizontal component useful to support insulation.

The X-hanger just described has certain advantages over prior art hangers, and specifically, over conventional hangers that are made of linear, rod-like elements. Specifically, because the coupler of the instant hanger prevents relative translation or rotation of the X-hanger's rods, no portion of the hanger can rotate down during or after installation. This is because the device is held in place by four points of contact that are held rigidly with respect to one another, rather than two. This ensures that the insulation batt is held firmly against the ceiling, which eliminates air gaps with the ceiling, and enhances insulation.

Another aspect of the invention involves a method for supporting a material in a building and includes the steps of: placing an insulation material between two beams of a structure; expanding the serpentine section of a hanger and bending the vertical portions to create a space between the u-shaped portions and the horizontal support surface portion that is equal to the thickness of the insulating material; and securing the u-shaped portions to adjacent beams or rafters of the structure.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

Figure 1:
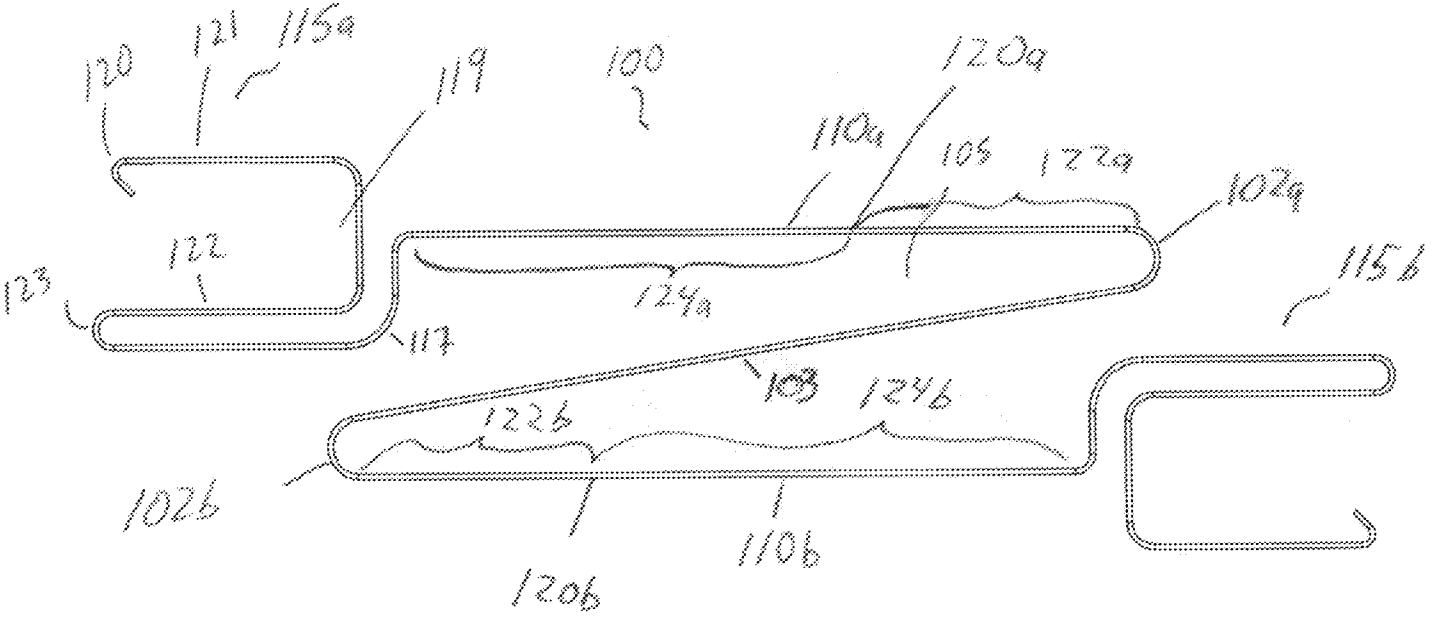
FIG. 1 is a top view of a z-shaped insulation hanger according to one embodiment, in a flat-packed, pre-installation configuration.
Figure 3:
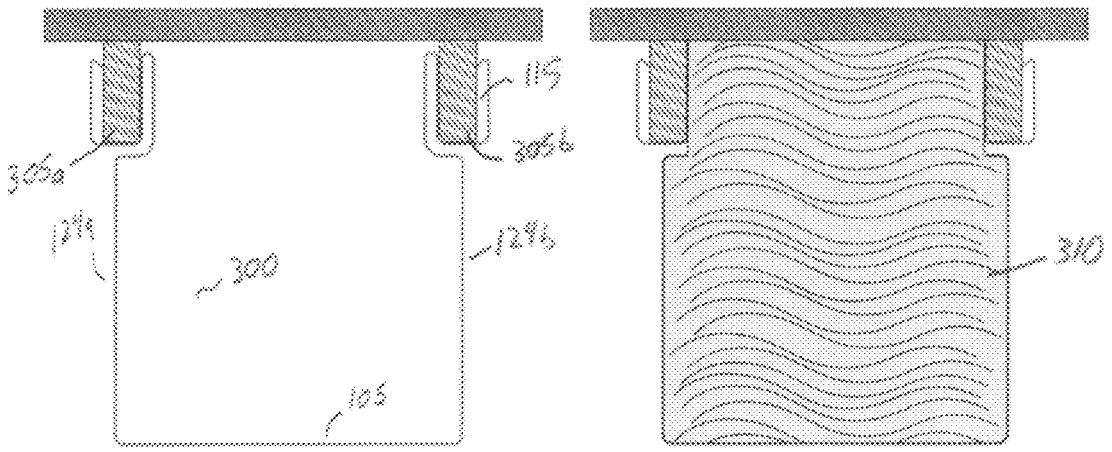
FIG. 3 shows two views of the hanger of FIG. 1 in an installed configuration onto a pair of ceiling joints, both with and without insulation.

Referring to FIG. 1, the numeral 100 identifies an article in accordance with the invention for holding or confining a material such as insulation (e.g., see FIG. 3, 310). The holding article 100 includes a non-linear (i.e., not defining a straight line) supporting element 105 which is arranged in a z-shape and functions to support the material. The supporting element 105 is elongated and has spaced longitudinal ends 110*a*, 110*b*, and an anchoring element 115*a* is secured to one of the ends while another anchoring element 115*b* is secured to the other of the ends. The anchoring elements 115*a, b* serve to anchor or fix the article 100 to the beams of a structure (not shown in this view, but visible in FIG. 3). Preferably, the entire holder 100 is constructed as a single piece, and the various structures described are integral to the holder and formed by bending a single linear piece of material (e.g., a metal rod).

The supporting element or support section 105 includes a central linear section 103, at least two bend sections or loops 102*a, b*, and optionally, at least some portions (e.g., 122) of longitudinal ends 110*a*, 110*b*. The support section 105 is preferably provided as a linear, metallic rod, that is bent in an accordion or serpentine fashion resembling a Z. Other serpentine forms are possible such as a sinusoidal form or a W. Support section forms an expandable, shelf like surface capable of supporting an object such as unillustrated insulation. More generally, the entirety of article 100 (which may be referred to herein as a "hanger") may be fashioned from a single piece of bent metallic rod. In a preferred embodiment, the rod used to fabricate hanger 100 is steel and has a circular cross section having a diameter of 1-3 mm (e.g., 14 or 16 gauge steel rod). but other configurations are possible. For example, in other embodiments, hanger 100 may be formed of aluminum, titanium or some other relatively stiff but bendable metal or alloy of metals. In other embodiments, hanger 100 may have a composite structure, for example, with a ductile metal rod forming an inner core that is clad in some other polymeric or composite material such as thermoplastic, polycarbonate, polystyrene, nylon, polyester, fiberglass, foam, carbon fiber or the like. In certain embodiments, the cross section of hanger 10 is non-circular, and may be rectangular, triangular, ovoid, or some polygonal shape. The thickness or diameter of the rod that forms hanger 100 may vary. The cross section of the rod that forms hanger 100 may vary, both in terms of its shape and its linear dimensions, throughout its length. Thicknesses or diameters of anywhere from 1 to 10 mm are acceptable, depending on the ductility of the material used.

Longitudinal ends 110*a,b* may serve a dual purpose, depending on how the hanger 100 is installed. In all cases, longitudinal ends 110*a,b* serve to connect support section 105 to the first and second anchoring elements 115*a, b*. Longitudinal ends 110*a,b* may also serve as part of support section 105, when the hanger 100 is bent to be installed, as is illustrated in any of the installed configurations show in FIG. 4. Indeed, the arrangement of FIG. 1 shows the hanger 100 in one of several different possible configurations. As pictured in FIG. 1, hanger 100 is flat, which is to say that the center, longitudinal axis of the metallic rod that forms anchor 100 is contained all in one plane (i.e., the plane of the page of FIG. 1). When in the configuration of FIG. 1, multiple hangers 100 may be stacked together and conveniently stored or packaged for shipment in a flat-pack box.

Figure 4:
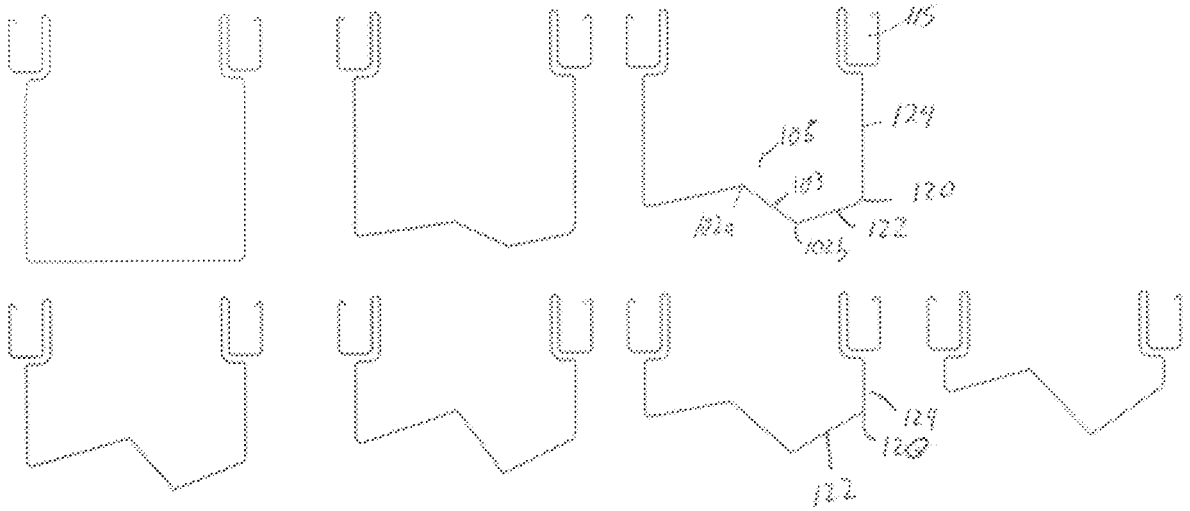
FIG. 4 shows various installed configurations of the hanger of FIG. 1 for various insulation thicknesses and inter-rafter widths.

During installation, an installer or user will select a bend point 120*a,b* on each of the two longitudinal ends 110*a,b* (typically at the same point on each longitudinal end relative to loop 102*a,b* or anchoring section 115*a,b*). The user will then bend a first portion of each longitudinal end (e.g., 124*a,b*) such that its long axis becomes orthogonal to a plane containing the support section 105 (i.e., the plane containing the center axis of the rod that defines bend sections 102,*ab* and central linear section 103). This is done on both sections 110*a,b*. The result is that section 124*a,b* is bent to extend vertically when sections 122*a,b*, 102*a,b*, and 103 remain horizontal, such that those latter sections form a support shelf for insulation, while the anchoring sections 115*a,b* extend vertically up and away from the support section, and the openings open upwardly to receive the edges of ceiling studs or rafters. In practice, an installer will select the location of bend points 120*a,b*, which is variable, in accordance with the thickness of the insulation being installed. The position of the bend points 120*a,b* determines the length of vertically extending portion 124*a,b*, and therefore, the distance between the anchoring sections 115*a,b* and the plane of the support section 105. In this way, the hanger 100 may be put in any number of configurations to support insulation rolls having various thickness, where preferably, the length of vertically extending section 124*a.b* is selected to place the level of support section 105 (when the hanger is installed onto rafters) at a distance of one insulation thickness below the ceiling between the rafters. This ensures that the insulation is positioned to be in contact with the ceiling between rafters, as shown in FIG. 3. The ability of the hanger 100 to accommodate varying thicknesses of insulation is illustrated in FIG. 4.

The hanger 100 of FIG. 1 includes a pair of anchoring structures 115*a,b*. Each anchoring section 115*a,b* preferably includes an upwardly opening, U-shaped clamping structure. Anchoring structure 115*a.b* includes a first and second vertical portions 121, 122, joined at the bottom of the U by a horizontal portion 119. The clamping structure is sized to engage with and receive the bottom edge of a ceiling rafter or beam (e.g., a 2×6" beam) and to have an interference fit with said beam. This is illustrated in FIG. 3. The width of clamping structure may vary, but preferably it is sized such that the distance between vertical sections 121 and 122 (determined at the structure's bottom by horizontal portion 119) is such that the spacing between the medial (with respect to the U) edge of hook 120 and the medial (with respect to the U) edge of portion 122 is slightly smaller than the width of the beam to which the hanger is secured. In one embodiment, the horizontal distance between portions 121 and 122 is 1.8", and the distance between the medially pointing end of hook 120 and portion 122 is somewhat less than 1.5", which the approximate width of a 2×4" or 2×6. If this condition exists, vertical sections 121 and/or 122 are deflected from one another upon installation and exert a squeezing spring force on the beam received therebetween. Preferably, hanger 100 also includes a hook 120, which is forced into the face of a ceiling beam by the aforementioned clamping force such that hanger is held more securely to the beam.

Anchoring sections 115*a,b* also include a transition section 117, that acts to connect and form a transition between the U-shaped clamping structure and the vertical portion 124*a,b* of the longitudinal ends 110*a,b*. In particular, transition section 117 forms the transition between vertical portion 124*a,b* and vertical portion 122 of the clamping structure. In the preferred structure of FIG. 1, transition section 117 bends away from the long axis of section 124, medially and toward a vertical centerline of hanger 100 (see FIG. 3), then straightens vertically before looping around to form a closed end loop 123 and the remainder of the U-shaped clamping structure. Closed end loop 123 acts as a stud finder, and its distal end (on the high side) sits higher than the distal end vertical portion 121, which terminates in a hook 120. The difference in height between stud finger vertical section 122 and the hook section 121 confers significant advantages over the prior art because it enables an installer to locate the edge or corner of a stud with the pair of stud finders while the hook 120 is down, relative to the studs, and out of the way where it will not snag. Once the edges of the studs have been found, the hanger may be pushed up into place, and the rounded terminus of the stud finder 122 enables easy alignment of the clamping sections, which are aligned to the studs as the corners/edges of the studs roll off the curve of the stud finder loop 123 as the hanger is pushed up. In preferred hangers the height difference between elements 122 and 121 is in the range of 1-5 cm, but other differences are possible.

While the preferred arrangement for the stud finder is as pictured, the invention is not so limited. Other configurations where one side of the u-shaped clamping section 119 is higher than the other may have similar advantages and are within the scope of the invention. Additionally, configurations where both sides (i.e., 121 and 122) have the same vertical extent are also possible, although not as advantageous. While the arrangement of the figures shows stud finders arranged symmetrically (e.g., both stud finders being located on the insides or medial sides of each of the anchoring portions, such that they engage the insides of a pair of adjacent studs, as shown in FIG. 4), this is not a requirement. In alternative arrangements, the stud finders for each u-shaped anchoring portion for the hanger may be located on the same side of each anchoring portion (e.g., both on the left or both on the right). In other arrangements, the stud finders are located on the lateral sides of the U-shaped clamping structures such that they locate outside surfaces of a pair of adjacent ceiling studs. The preferred arrangement, however, is particularly advantageous because it easily allows an installer to find the inside edges of an adjacent pair of studs with the hanger's medially arrange stud finder, and then push the hanger upward, so that the laterally arranged arms 121 deflect out around the studs' outside edges as the hanger is pushed up.

The transition section 117 and stud finder 123 just described have two advantages in addition to supporting the ability to locate a stud edge. First, the transition section 117 may act as a spring that allows the entirety of clamping structure 119 to deflect away from the axis of section 124, which may be helpful in aligning and pushing both clamping sections of a hanger 100 onto a pair of rafters. Second, transition section 117, positions the center of the horizontal, bottom portion 119 of the U-shaped clamping structure in line with the long axis of vertical section 124 such that the lateral edges of the shelf-like supporting structure 105, which are defined by bend point 120, will be below the centers of the beams or rafters on which the hanger is installed. This can be seen in FIGS. 3 and 4, where the U-shaped clamping structures are centered above the vertical sections (124*a,b*) of the hanger. This permits insulation supported by structure 105 to be wide enough to cover the space beneath half the thickness of the beams to which the hanger is mounted. The other half of each beam will be covered by adjacent rolls of insulation supported by adjacent hangers. The result is complete insulation coverage below the studs or rafters, which is an advantage relative to prior art methods. This complete coverage may be seen more clearly in FIG. 3, which shows the insulation between squeezed between two studs 305*a,b*, above the level of the studs, but the insulation has expanded out to vertical portions 124*a,b*, where it covers half of the underside of the studs.

Referring now specifically to FIGS. 1 and 3, there is shown a schematic sketch of a hanger 300 (which may be the hanger 100 discussed above with respect to FIG. 1), installed between a pair of ceiling rafters or studs 305*a,b*. In the left hand pane of FIG. 3, insulation 310 is omitted for clarity. As can be seen, in this embodiment, the transition portion (117 in FIG. 1) is arranged to position the U-shaped clamping structures with respect to vertical portions 124*a, b* such that those vertical portions 124*a,b* are located beneath the vertical centerlines of the studs 305*a, b*. This condition is achieved by positioning the vertical centerline of the U-shaped clamping structure approximately over a vertical axis defined by vertical portions 124*a,b*, but in practice, the centerlines of the U-shaped clamping portions are shifted somewhat laterally to accommodate the medially facing hooks. In practice, a highly advantageous configuration is achieved when the vertical axes defined by vertical portions 124*a,b* bisect a horizontal axis connecting the medial tips of the hooks 120 and the lateral, vertical portions of the stud finders 122 when the hanger is installed, because that distance is equal to the width of the stud.

By positioning the vertical axes of vertical portions 124*a,b* below the vertical centerlines of the studs or rafters, the insulation (right pane of FIG. 3) can expand to fill the space between portions 124*a, b*, which ends up resulting in insulation coverage over half the width (the inside or medial widths) of the studs to which the hanger is installed. Additional hangers and insulation are then installed on additional pairs of studs (i.e., another hanger and insulation are installed between on the righthand most stud in FIG. 3, and the next ceiling stud to the right), and this process is repeated across the ceiling. Since the insulation between each adjacent pair of rafters is confined to the area between the vertical centerlines of pairs of rafters, the insulation achieves full coverage over the studs without interference between adjacent rolls of insulation, and without the need for trimming, as in the prior art. This provides for better insulation, without insulation gaps, and without additional wasteful trimming steps.

As was described above, the first installation steps using the hanger 100 of FIG. 1 are to determine the bend points 120, which will generally be determined by the thickness of the insulation. The next step is to stretch the support section 105 (i.e., to pull linear ends 110*a* and 110*b* away from one another) so that loop sections 102*a,b* open. This increases the width of the horizontal support surface, and the spacing between vertical sections 124*a,b*. The width of the support surface is increased until it reaches a predetermined width determined by the width of the insulation roll and/or the inter-rafter spacing (typically 18" or 24"). In this way, the hanger of the present disclosure may have one of a variety of configurations. The pre-installation configuration is illustrated in FIG. 1. Referring now to FIGS. 1 and 4, FIG. 4 shows a number of other configurations for different thicknesses of insulation. As can be seen in FIG. 4, an installer may select first and second bend points 120 to bend the longitudinal ends up to create vertical portions 124, which place the U-shaped anchoring elements 115 in a vertical configuration for installation. The remaining elements of the hanger, consisting primarily of the horizontal support structure 105 remain horizontal. The bend points are chosen to accommodate varying thicknesses of the insulation batt, and to position the insulation a desired distance from the ceiling, and preferably, in contact with the ceiling as shown in FIG. 3. For some relatively thin insulation rolls (e.g., 4"), the vertical portion (e.g., 124 in FIG. 1) will be relatively short, and the support element 105 will retain its serpentine form and will include a good deal of portion 122 as part of the horizontal support surface, thereby providing a greater lateral support "shelf" for the insulation. For very thick insulation rolls (e.g., 10"), the support element 105 may have to be stretched a long way (even to the point of completely straightening bends 102*a, b*. In these cases the bend point 120 may be very close to loops 102*a,b*, or it may even be in the central portion of the structure 105. In these cases, support element 105 may be converted to a linear structure, rather than a planar structure, as shown in FIG. 4, but this is an extreme case. In general, it is contemplated and preferred that after setting the vertical extent of vertical portions 124, the horizontal supporting element 105 will be expanded by stretching to provide a horizontal support shelf. This is made possible by the z-shaped accordion or serpentine like structure of portion 105. Again, the width of the horizontal structure (determined by the degree or expansion or stretching) is preferably determined by the inter-rafter spacing of the ceiling receiving an installation (typically 18 or 24 inches on center).

Figure 2:
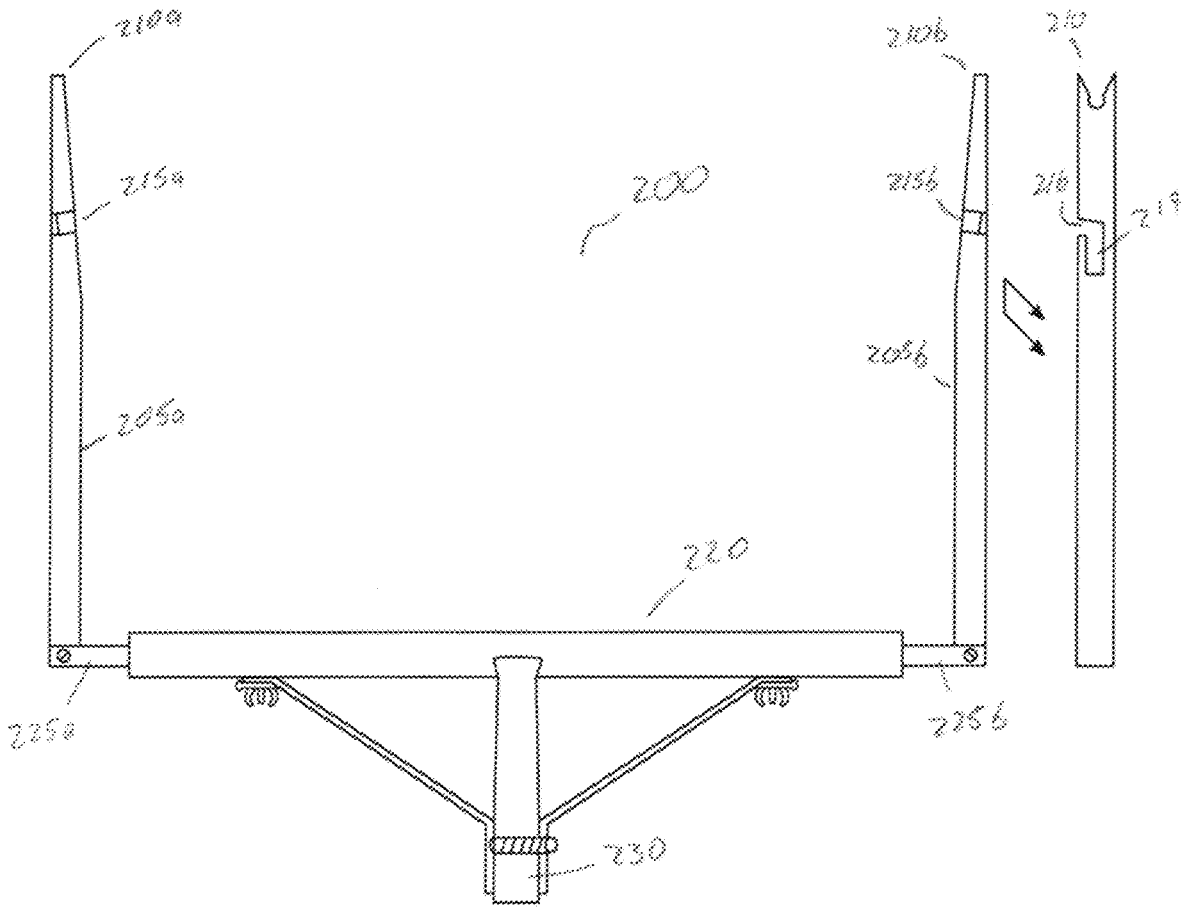
FIG. 2 is a front view of an installation tool for the hanger of FIG. 1, including a side detail view.

Referring now to FIG. 2, there is shown an installation tool for installation an insulation hanger of the sort depicted and described in relation to FIGS. 1, 3 and 4. The tool of FIG. 2 200 generally has a bottom, horizontal, linear portion 220 and two vertically extending arms 205*a,b*. Bottom portion 220 is attached to vertical arms 205*a,b* such that the tool defines an upwardly facing, square U-shaped interior space. Each of the vertical arms 205*a,b* includes a cutout 215*a,b* that defines an L-shaped space within the interior of each arm 205*a,b*, with the long side of the L pointing down, and the short side of the L pointing toward a back or front face of the arm 205*a,b*. The proximal end of each arm 205*a,b* is coupled to an end of the horizontal portion 220, and the cross sectional area of each arm 205*a,b* tapers in the distal direction relative to portion 220. The taper of the arms allows an unrolled roll of insulation to placed into the U-shaped portion after a hanger (i.e., the hanger of FIGS. 1, 3-4) has been loaded into the tool.

The spacing between arms 205*a,b* is adjustable and fixable, and may be adjusted and fixed with set screws and slots or other arrangements adjustably coupling arms 205*a,b* to the bottom portion 220. In order to accomplish this, sliding arms 225*a,b* may be included in bottom portion 220. Sliding arms 225*a,b* may be coupled to vertical arms 205*a,b* in a L fashion, as shown. Sliding arms may be slotted into an interior volume defined by bottom portion 220, which may be fashioned as a metallic tubular member (e.g., out of hollow, square aluminum bar stock) for this purpose. The tubular member may have a slot (or pair of slots) machined on a bottom surface, though which a set screw (or pair of set screws) engages sliding arms 225*a,b*. The screw or screw may be loosened such that the arms 225*a,b* can slide with respect to bottom portion 220, and then tightened to fix the arms 225*a,b* with respect to bottom portion when the desired position is reached.

Bottom portion 220 may also include a handle or a sleeve for securing tool 200 to a pole (e.g., a telescoping poll) enabling an installer to reach ceiling studs from the floor.

To use tool 200, an installer preferably bends and expands the hanger (i.e., hanger 100 shown in FIG. 1) such that the vertical portions 124*a,b* are the correct length and the horizontal support portion is the correct width. Then, the hanger is placed into the tool such that cut-outs 210*a,b* located on the top of the tool engage and support the bottoms of the closed loops 123 of the hanger's stud funder. The transition portions 117 of the hanger are slotted into L-shaped cutouts 215*a,b* on the tool. Thus, the vertical spacing between elements 210*a* and 215*a* and 210*b* and 215*b* are chosen to allow the tool to engage and support the top of the stud finder loop 123 and the portion of the transition portion 117 directly below the stud finder loop. In this embodiment, the arms 205*a,b* are set to be inside of the inter-rafter spacing.

In alternative embodiments, the tool is configured to engage the hook sides of the U-shaped clamping members of the hanger. In these embodiments, slots 210*a,b* engage and support the undersides of the hooks 120 on vertical portions 121, and the slots 215*a,b* engage the portion of horizontal portion 119 that is directly below the hook 120. In these embodiments, the width between the arms 205*a,b* is sized to place the arms outside of a pair of adjacent rafters.

An installer will load a bent hanger into the tool of FIG. 2 by pushing the relevant portion of the hanger over projection 216, and then letting it fall down into portion 217 as the other portion of the hanger comes down into engagement with slots 210*a, b*. In this way, the hanger is supported vertically by bottom edge 217 and cannot fall out horizontally because of projection 216. After the hanger is loaded, a batt of insulation is placed on top of the hanger's support surface (which will be in the tool's interior above portion 220). The tool and the insulation are then raised to the ceiling, and the hanger 100 is pushed onto a pair of ceiling studs, such that the U-shaped anchoring portions engage the studs as described above and illustrated in FIG. 3. To release the tool, it is shifted downward slightly, then laterally so that the hanger is released from the tool's cutout 215*a,b*. As is set forth above, handle 230 is preferably attached to a pole, which may be telescoping, so that this operation may be conducted safely from the floor.

Figure 5A:
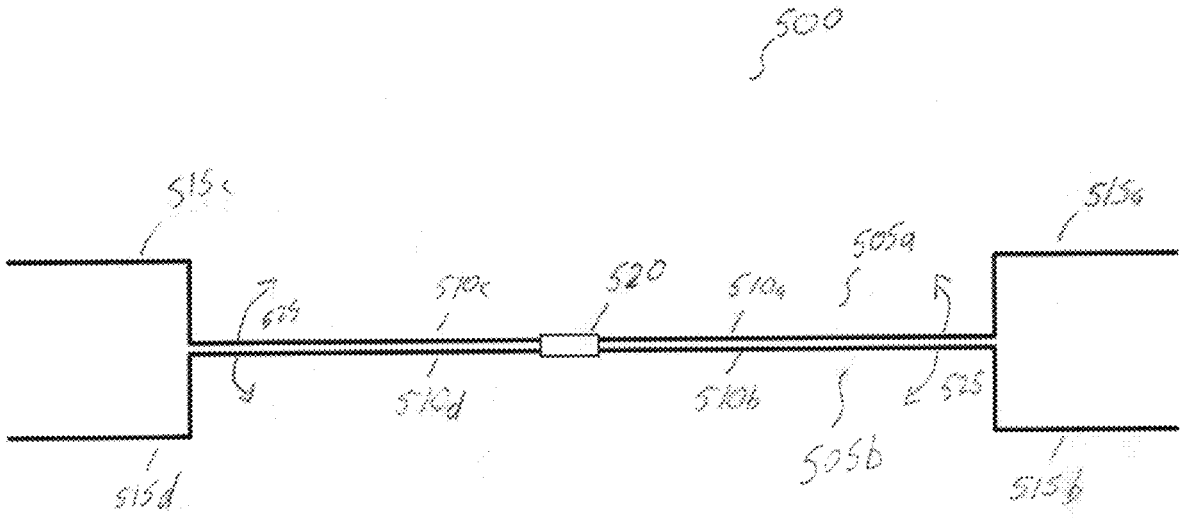
FIGS. 5A and 5B show two x-shaped insulation hangers according to alternative embodiments.
Figure 5B:
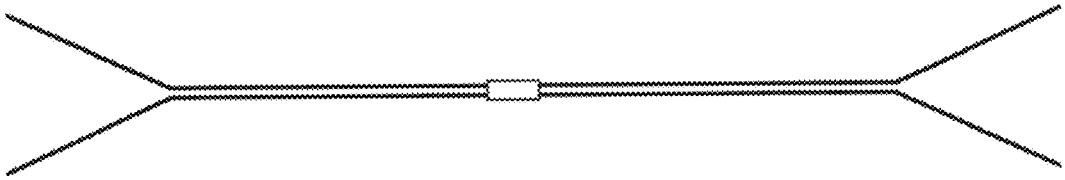

FIGS. 5A and 5B show alternative embodiments of insulation hangers. In the embodiments of FIGS. 5A and 5B, hangers 500 comprise at least two flexible rods 505*a* and 505*b*. Rod 505*a* (on top) comprises medial segments 510*a,c* and lateral segments 515*a,c*, and rod 505*b* (bottom) comprises medial segments 510*b,d* and lateral segments 515*b,d*. The flexible rods may preferably be steel rods having a circular cross section with a diameter of between 1 and 10 mm, but other configurations such as the various configurations discussed above in connection with the hanger of FIG. 1 are possible. Rods 505 *a,b* are joined together at their midpoint by coupler 520. Coupler 520 is preferably formed of a clip with two hollow cylindrical and mutually parallel barrels that are joined together or are integral to each other. Coupler 520 is preferably crimped, welded or riveted to rods 505*a,b*, such that coupler holds rods 505*a,b* in a fixed position relative to one another, and prevents rods 505*a,b* from rotation along their long axis relative to one another. That is, coupler 520 holds rods 505*a,b* fixed relative to one another in both rotation and translation at the point of the coupler.

In alternative embodiments, hanger 500 comprises four rod segments extending from clip 520 laterally, i.e., a first rod with segments 510*a* and 515*a*, a second rod with segments 510*c*, 515*c*, a third rod with segments 510*b*, 515*b*, and a fourth rod with segments 510*d*, 515*d*. In such embodiment, all rod segments are captured by coupler 520 and held fixed, in rotation and translation, relative to one another at the coupler.

Each rod 505*a,b*, has a pair of medial portions 510*a,c* and 510*b,d*, and a pair of distal portions 515*a,c* and 515*b,d*. Medial portions 510*a-d* are straight and linear and medial with respect to an up-down centerline axis in the plane of FIGS. 5A and 5B. Distal portions 515*a-d* are distal with respect to coupler 520, and are non-parallel with respect to the long axes of their respective medial portions 510*a-d*. Distal portions 515*a-d* may be non-linear or incorporate non-linear elements, as in FIG. 5A. Distal portions 515*a-d* serve to increase the lateral extent (lateral being the defined with respect to the plane of the page of FIGS. 5A and 5B), and therefore to increase the lateral extent of a horizontal support surface for insulation provided by the hangers shown in FIGS. 5A and 5B. This may be accomplished, preferably, by providing a first rod 505*a* having a distal portions 515*a,c* deviate laterally from their respective medial portions 510*a,c* in a first lateral direction (the upward direction in the figures), and a second rod 505*b* with distal portions 515*b,d* that deviate laterally from their respective medial portions 510*b, d* in a second, opposite lateral direction (the downward direction in the figures). While FIGS. 5A and 5B show distal sections 515*a-d* formed of linear segments, this is not a requirement. Distal sections 515*a-d* may alternatively be curved portions of the rods 505*a,b* or combinations of curved portions and linear portions. In some embodiments, distal sections 515*a-d* do not deviate from the long axis of the medial portions 510*a-c*, and the entirety of the rods 505*a,b* is straight, prior to bending, as will be discussed below.

The hangers 500 of FIGS. 5A and 5B are pictured in a first configuration, where the medial sections of rod 505*a* (510*a, c*) are mutually parallel and preferably coaxial, as are the medial sections of rod 505*b* (510*b,d*). Additionally, in the configuration shown in FIGS. 5A and B, the medial sections of rod 505*a* are parallel to and adjacent to the medial sections of rod 505*b*. In a preferred embodiment, the hangers 500 of FIGS. 5A and 5B may be bent by a user into a second configuration by bending each of rods 505*a,b* up or down, with respect to a centerline running horizontally in the plane of the Figures through coupler 520, as shown by directional arrows 525. In this second configuration, distal sections 515*a,b* and distal sections 515*c,d* are bent up or down and away from one another such that the lateral extent of hanger 500 in the plane of the Figures increases to provide more of support surface for insulation. This second configuration is shown in the Top View of FIG. 6, which shows the hanger of FIG. 5A just prior to installation. By the bending process, an angle is imparted between medial sections 510*a* and 510*b* and between 510*c* and 510*d*. This angle may be the same on both sides, or it may vary. The result is a substantially X shape being formed by the medial sections, which may be straight, or curved as is shown in FIG. 6.

Figure 6:
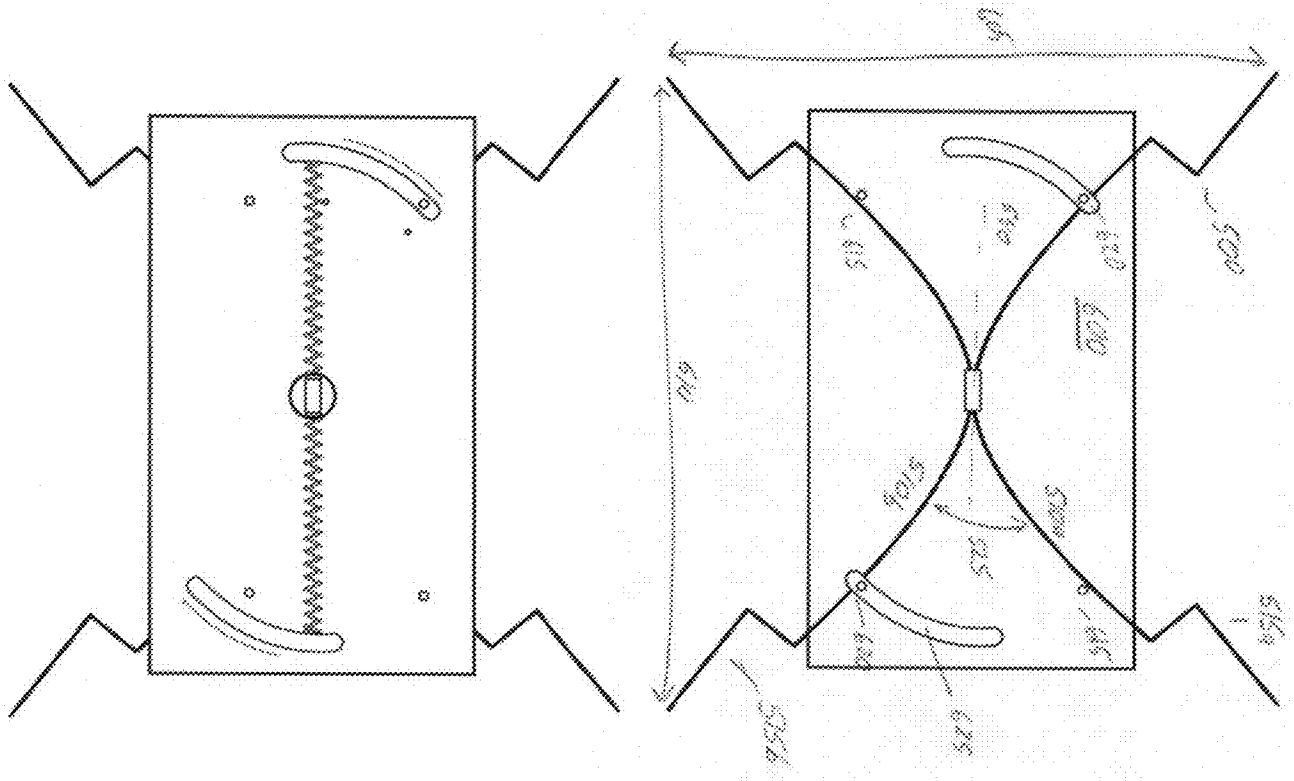
FIG. 6 shows top and bottom views of an installation tool usable for installing the hangers of FIGS. 5A and 5B.

Referring now to FIG. 6, there are shown top (top) and bottom (bottom) views of an installation tool 600 usable to install a hanger 500 of the sort depicted in FIG. 5A or 5B. The tool 600 has a horizontal platform on which are mounted a pair of stationary pins 615 and a pair of mobile pins 620, which may move, in opposite directions, in a curved manner as shown. Curved slots 625 are provided to accommodate the movement of the moveable pins. The movable pins are actuated by a user by an unillustrated user operable actuation device, and a pair of springs is provided to return the pins to their default position after installation. By moving the movable pins 620, the distal ends of the rods (e.g., 515*a-d*) are deflected laterally, and the medial portions of the rods (e.g. 510*a-d*) are bent and spread, imparting an X-shape to the hanger. This X-shape is a second configuration, as compared to the uninstalled configuration shown in FIGS. 5A and 5B. In the install configuration of FIG. 6, the distal sections of the rods have been bent up and down relative to centerline 540, as shown by the directional arrows 525. In practice, an installer bends the distal ends of the rods as shown in FIG. 6 so that a lateral dimension of the hanger is slightly larger than the spacing between inside facing vertical surfaces of ceiling studs or rafters. This condition is set for either dimension 605 or 610. Because its lateral extent (in either dimension 605 or 610) is slightly greater than the inside spacing between adjacent rafters, the hanger 500 can be pushed up between rafters where it will have a tight, interference fit. In practice, during this process the ends of the distal sections 515*a-d* will scrape along the vertical, mutually facing faces of a pair of adjacent rafters, and will deflect downward relative to the rest of the hanger as it is pushed up between the rafters. The ends of the distal sections 515*a-d* of the rods will then tend to dig into the wood of the rafters if the hanger is subject to downward force (i.e., by insulation being supported by the hanger). Distal ends of distal sections 515*a-d* may be angled or sharped to help the hanger dig into the rafters.

To install the hanger of FIG. 5A or 5B, an installer will place an insulation batt between an adjacent pair of ceiling studs or rafters, bend the rod sections on both sides of the central coupler such that the hanger has an X-shape, and such that the hanger has an outside lateral dimension that is slightly larger than the inside spacing between a pair of adjacent studs, and then push the bend hanger up between the studs until the insulation batt is pinned to the desired position (e.g., in contact with the ceiling). Because the coupler 520 holds the rods of the hanger 500 fixed, in rotation and translation, relative to one another, neither rod can rotate or translate down relative to the other once the hanger has been installed. Each rod, the ends of which are dug into the rafters, provides support for the other rod though the rigid coupler-which is an advance over the prior art. Rotation and translation of the entire device is prevented by four fixed points of contact, and cannot occur despite the hanger being bowed in an upward direction by tension. This is a significant improvement over prior art hangers, which are fashioned from a single rod with sharp ends, which may rotate down after installation.

Various changes in the details and components that have been described may be made by those skilled in the art within the principles and scope of the invention herein described in the specification and defined in the appended claims. For example, the holders of the invention may be used to "double stack" insulation (i.e., hang a second layer of insulation) where previously installed insulation is inadequate or has become compressed and lost some of its "R-value." Thus, the adjustable width and length of the holder of the invention is useful for retrofitting existing structures. Moreover, the terms "beams", "rafters" and "studs" are meant to encompass a wide variety of structures (i.e., not just rectangular or I-shaped structures) between which insulation or other building materials would commonly be disposed. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. An article for holding a material in place, the article having an installed configuration in which the article comprises:

a support element having a wire element bent in a serpentine pattern to define horizontal support surface contained in a plane;

a first vertical wire member coupled to a first side of the support element, and a second vertical wire member coupled to a second side of the support element, the first and second vertical wire members extending upwardly and orthogonally to the plane of the support surface;

a first clamping element connected to and arranged at an upper end of the first vertical wire member, and a second clamping element connected to and arranged at an upper end of the second vertical wire member, the first and second clamping elements arranged as upwardly opening, square, U-shaped members each having a vertical medial element, a vertical lateral element, a horizontal bottom element connecting the vertical elements, wherein for each clamping element, one of the vertical elements terminates in a medially facing hook, and the other vertical element terminates in a closed loop, the closed loop being farther away, vertically, from the horizontal bottom element than the hook;

for each clamping element, the distance between the vertical elements is such that the clamping elements may receive a ceiling stud that is held in spring tension between the vertical elements; and the clamping elements are arranged with respect to the vertical wire members such that vertical axes that are coaxial with the vertical wire members bisect a downward facing surface of a ceiling stud received in the clamping elements.

2. The article of claim 1, wherein the article is fashioned from a single piece of bent metal wire.

3. The article of claim 2, wherein bent metal wire is 14 or 16 gauge steel rod.

4. The article of claim 1, wherein the article has an uninstalled configuration in which the first and second vertical members, the support element and the first and second clamping elements are all contained in the same plane.

5. The article of claim 1, wherein for each clamping element, the vertical elements terminating in a medially facing hook are located on lateral sides of their respective clamping elements, and the vertical elements terminating in closed loops are located on respective lateral sides of their respective clamping elements.

6. The article of claim 1, wherein for each clamping element, the closed loops are between 1 and 3 cm farther away, vertically, from the horizontal bottom elements than the hooks.

7. The article of claim 1, wherein the clamping member is a square U shape.

8. An insulation installation system comprising

A hanger for holding a material in place, the hanger comprising:

a support element having a wire element bent in a serpentine pattern to define horizontal support surface contained in a plane;

a first vertical wire member coupled to a first side of the support element, and a second vertical wire member coupled to a second side of the support element, the first and second vertical wire members extending upwardly and orthogonally to the plane of the support surface;

a first clamping element connected to and arranged at an upper end of the first vertical wire member, and a second clamping element connected to and arranged at an upper end of the second vertical wire member, the first and second clamping elements arranged as upwardly opening, square, U-shaped members each having a vertical medial element, a vertical lateral element, a horizontal bottom element connecting the vertical elements, wherein for each clamping element, one of the vertical elements terminates in a medially facing hook, and the other vertical element terminates in a closed loop, the closed loop being farther away, vertically, from the horizontal bottom element than the hook;

for each clamping element, the distance between the vertical elements is such that the clamping elements may receive a ceiling stud that is held in spring tension between the vertical elements; and the clamping elements are arranged with respect to the vertical wire members such that vertical axes that are coaxial with the vertical wire members bisect a short dimension of ceiling studs received in the clamping elements; and an installation tool comprising a horizontal base portion and two vertical arms coupled to the horizontal base portion at first and second ends of the horizontal base portion, wherein each of the vertical arms has a pair of cutouts positioned to engage and support both a closed loop and a bottom of a clamping member of the hanger.

9. The system of claim 8, wherein, for the installation tool, one of the cutouts on each arm is located at an upper, distal end of each arm.

10. An insulation hanger, comprising:

a first and second rod of equal length joined together at their respective midpoints by a coupler attached to the first and second rods such that the rods are rigidly held together and cannot translate or rotate with respect to each other, wherein the rods are bendable to form a planar holding surface, wherein the coupler comprises a pair of hollow cylindrical, mutually parallel barrels rigidly fixed to the first and second rod by one of crimps, welds or rivets.

11. The insulation hanger of claim 10, wherein each rod has a central portion proximate to the coupler and an end portion, and wherein the end portion deviates from an axis defined by the central portion to increase a lateral extent of the planar holding surface.

* * * * *